US011846044B2

(12) United States Patent
Ripamonti et al.

(10) Patent No.: US 11,846,044 B2
(45) Date of Patent: Dec. 19, 2023

(54) DEVICE AND METHOD FOR PRODUCING FANCY YARNS

(71) Applicant: SSM GIUDICI S.R.L., Galbiate (IT)

(72) Inventors: Antonio Ripamonti, Usmate Velate (IT); Giuseppe Bosisio, Castello di Brianza (IT); Roberto Badi, Erba (IT)

(73) Assignee: SSM GIUDICI S.R.L., Galbiate (IT)

( * ) Notice: Subject to any disclaimer, the term of this patent is extended or adjusted under 35 U.S.C. 154(b) by 485 days.

(21) Appl. No.: 17/058,963

(22) PCT Filed: May 22, 2019

(86) PCT No.: PCT/EP2019/063245
§ 371 (c)(1),
(2) Date: Nov. 25, 2020

(87) PCT Pub. No.: WO2019/228891
PCT Pub. Date: Dec. 5, 2019

(65) Prior Publication Data

US 2021/0214863 A1 Jul. 15, 2021

(30) Foreign Application Priority Data

May 30, 2018 (IT) ..... 102018000005854

(51) Int. Cl.
*D02G 1/16* (2006.01)
*D01H 5/36* (2006.01)
(Continued)

(52) U.S. Cl.
CPC ..... *D02G 1/162* (2013.01); *D01H 5/36* (2013.01); *D01H 7/923* (2013.01); *D02G 1/008* (2013.01); *D02J 1/06* (2013.01); *D02J 1/08* (2013.01)

(58) Field of Classification Search
CPC ..... G02G 1/162; G02G 1/14; G02G 1/008; G02G 1/024; D01H 5/36; D01H 5/44;
(Continued)

(56) References Cited

U.S. PATENT DOCUMENTS 3,086,347 A 4/1963 Keen et al.
3,377,792 A 4/1968 Walls et al.
(Continued)

FOREIGN PATENT DOCUMENTS

CN 1664198 A 9/2005
CN 102787413 A 11/2012
(Continued)

OTHER PUBLICATIONS

English translation of DE 3800899 to Cernikevic, obtained via espacenet.com (last visited May 9, 2023). (Year: 2023).*

*Primary Examiner* — Patrick J. Lynch
(74) *Attorney, Agent, or Firm* — McGlew and Tuttle, P.C.

(57) ABSTRACT

The device (1) comprises a first roller (3) rotatable about a first rotation axis (3A) and a second roller (5) rotatable about a second rotation axis (5A), parallel to the first rotation axis (3A). The two are in mutual contact and define between them a yarn passage (7) and at least of them is motorized. The device further comprises 5 guide members (9) defining a feed path of at least a yarn (F; F1, F2, F3, F4), associated with the yarn passage (7) between the first roller (3) and the second roller (5). The guide members (9; 13) are movable with respect to the rollers (3, 5) in a direction substantially parallel to the first rotation axis (3A) and to the second rotation axis (5A), so as to take the yarn path temporarily outside the mutual contact 10 area between the rollers.

9 Claims, 8 Drawing Sheets

(51) Int. Cl.

| | |
|---|---|
| ***D01H 7/92*** | (2006.01) |
| ***D02G 1/00*** | (2006.01) |
| ***D02J 1/06*** | (2006.01) |
| ***D02J 1/08*** | (2006.01) |

(58) Field of Classification Search
CPC ..... D01H 5/58; D01H 7/923; D01H 7/926; D01H 13/04; D01H 13/06; D02J 1/06; B65H 57/28; B65H 57/00
See application file for complete search history.

(56) References Cited

U.S. PATENT DOCUMENTS

| | | | | | |
|---|---|---|---|---|---|
| 3,599,416 | A * | 8/1971 | Reuter | D02G 3/281 | 57/352 |
| 3,690,575 | A * | 9/1972 | Ito | B65H 54/2842 | 242/474.9 |
| 3,999,361 | A | 12/1976 | Ellis et al. | | |
| 6,820,405 | B2 | 11/2004 | Schaad | | |
| 2012/0144794 | A1 * | 6/2012 | Ke | B32B 5/02 | 57/90 |
| 2014/0356474 | A1 * | 12/2014 | Stundl | B29D 99/0078 | 425/380 |

FOREIGN PATENT DOCUMENTS

| | | | | |
|---|---|---|---|---|
| DE | 3800899 | A1 * | 8/1989 | B65H 57/28 |
| DE | 102006004894 | A1 * | 8/2007 | B65H 57/28 |
| EP | 0453622 | A1 | 10/1991 | |
| EP | 0829444 | A1 | 3/1998 | |
| EP | 3246438 | A1 | 11/2017 | |
| GB | 1332790 | A | 10/1973 | |
| GB | 2214528 | A | 9/1989 | |
| JP | 60056774 | A * | 4/1985 | B65H 54/28 |
| WO | 2004035446 | A1 | 4/2004 | |
| WO | 2009033697 | A1 | 3/2009 | |

* cited by examiner

Pa
1
13
3
15
5S
5R
5
3A≡5A
5S
9
11
F1
F2
F3
F4
fF
17
Pa
f9

1
Pa
15
7
3
3S
5R
13
5
5A
3B
3A
9
5S
17
11
fF
F4
F3
F2
F1
f9

DEVICE AND METHOD FOR PRODUCING FANCY YARNS

TECHNICAL FIELD

The invention relates to a device for producing fancy yarns, such as yarns with variable effects. Embodiments described herein relate in particular to multiple yarns, i.e., composite yarns composed of more than one initial yarn for example a core yarn and an effect yarn. The invention also relates to a method for producing fancy yarns, in particular fancy multiple yarns.

STATE OF THE ART

To produced slub yarns, i.e., effect yarns or fancy yarns, devices are known, which introduce a variation in tension in the yarn while it advances along a process path. For this purpose, in some devices a pick-up element, having a movement transverse to the yarn path, is provided along the processing yarn path. The pick-up element grips the yarn and moves it transversely, lengthening the path thereof, before releasing it suddenly. Devices of this type are disclosed in EP 0453622, EP0829444, U.S. Pat. No. 6,820,405, WO 2009/033697 and EP 3246438.

U.S. Pat. No. 3,999,361 discloses a method and a device for producing multiple yarns. The device comprises a system for imparting a false twist on the yarns. The system consists of a pair of rollers with parallel and counter-rotating axes, which define a nip therebetween. The yarn is made to pass through the nip with a trajectory parallel to the axes. To impart an intermittent false twist on the yarn, it is inserted cyclically into the nip and moved away from it by means of a guide provided with a reciprocating motion. The reciprocating motion of the guide is orthogonal to the plane containing the rotation axes of the two rollers.

GB 2214528 discloses a system for producing a fancy yarn, wherein a pair of yarns is fed to a twisting device. Of said two yarns, one forms the core and the other the external decorative thread of the fancy yarn that is formed by combining the two yarns. To obtain this effect, the two yarns are fed through a nip formed between two overfeed rollers. One of the two rollers is shaped, and has a central area of smaller diameter. By means of a guide comb the two yarns fed to the nip between the two overfeed rollers it is possible for one of the two yarns to be pinched between the two rollers and over-fed due to the peripheral speed of the rollers, while the other yarn remains in the area of smaller diameter of the shaped roller, so as to be fed at a lower speed. The yarn fed at lower speed forms the core of the fancy yarn obtained by combining the two yarns.

SUMMARY OF THE INVENTION

According to a first aspect, a device for generating variable effects on a yarn is provided, comprising a first roller rotatable about a first rotation axis and a second roller rotatable about a second rotation axis, approximately parallel to the first rotation axis. The first roller and the second roller are in mutual contact and define a yarn passage therebetween. At least one of the rollers is motorized. Moreover, the device has at least a first guide member defining a feed path for at least one yarn. The guide member is associated with the first roller and with the second roller and is adapted to guide at least a yarn through the passage defined between the first roller and the second roller. Moreover, the guide member and the two rollers are provided with a mutual, i.e., relative, movement in a direction substantially parallel to the first rotation axis and to the second rotation axis. With the translation movement the yarn can be taken periodically and temporarily outside the contact area between the first roller and the second roller, so as to temporarily interrupt the effect of the rollers on the yarn.

The term periodically, as used herein, must not necessarily be intended in the sense that the movement follows a periodic law of motion, with repetition at regular intervals of time of the translation motion. On the contrary, the translation movement of the yarn outside the mutual contact area between the rollers can also occur in a completely random manner. What is important is that the loss of contact between yarn and rollers is temporary, i.e., occurs for specific periods of time. In practice, the yarn is alternately pinched between the two rollers and free, outside the mutual contact area between the rollers.

By taking the yarn outside the mutual contact area between the rollers, and thus removing the effect of the rollers on the yarn, said yarn can, for example, undergo a temporary variation in tension, which forms slubs or similar effects on the yarn.

Although it is possible to carry out the mutual movement between rollers and guide member maintaining the latter fixed with respect to a supporting structure and moving the rollers parallel to their rotation axes, for simpler construction it is preferable to maintain the rollers with their axes fixed with respect to a supporting structure and to move the guide member with respect to the supporting structure and to the rollers.

The movement of the guide member can be controlled by any suitable actuator, for example through an electronically controlled actuator, which can be controlled by a programmable unit. In this way, it is possible, for example, to set a series of parameters such as the dwell time of the yarn path outside and inside the passage between the rollers in the mutual contact area therebetween. Moreover, it is possible, for example, to program the frequency of the translation movement of the guide member with respect to the rollers.

Preferably, for better control of the yarn, the device can comprise a second guide member movable in synchronism with the first guide member. To obtain a structure that is simpler and more easily controllable, the first guide member and the second guide member can be integral with a single supporting element, movable with respect to the pair of rollers. Advantageously, the first guide member and the second guide member can be positioned one upstream and the other downstream of the mutual contact area between the two rollers.

In some embodiments, one or both the rollers can have beveled edges to facilitate re-introduction of the yarn into the mutual contact area between the rollers.

In some embodiments, the device can be adapted so that the yarn exits on only one side of the pair of rollers, but it would also be possible for the yarn path to be modified by the guide member or members, so that it exits from the nip, i.e., from the mutual contact area between the two rollers, both on one side and on the other. However, as the effect that is obtained on the yarn is due to the temporary loss of contact with the two rollers, and this effect is independent of the fact that the yarn exits from the nip, i.e. mutual contact area, between the rollers on one side rather than the other, to reduce the travel required between the guide member or guide members and the rollers, in some cases it is preferable for the yarn path to be taken outside the contact area between the rollers always on the same side.

According to a further aspect, a machine for producing a fancy yarn is provided, comprising a feed path of at least a yarn from at least a feed spool to a winding bobbin, wherein along said feed path there is arranged at least a yarn processing member and at least a device as described above.

The machine can, for example, be an air texturizing machine, or a false twist texturizing machine, or a combined air and false twist texturizing machine.

The machine can be a shaft machine, i.e., a machine with several machining positions controlled by common control shafts that extend for the whole of the machine front. In other embodiments the machine can be a machine with individual positions.

According to a further aspect, a method for producing a fancy yarn is provided, comprising the steps of:

feeding at least a yarn along a feed path between a first rotating roller and a second rotating roller, in mutual contact and defining a yarn passage therebetween, wherein the two rollers are in mutual contact; and while the yarn advances along the feed path, temporarily moving the feed path outside the yarn passage between the first roller and the second roller and returning the feed path inside the yarn passage between the first roller and the second roller.

Further features and embodiments of a device according to the invention, of a machine that uses this device and of a method for treating yarns according to the invention are described hereunder and defined in the appended claims.

In the sense used herein, the term yarn designates in general a substantially linear, i.e., substantially one-dimensional, textile article of indefinite length. Preferably, the yarns are continuous yarns, i.e., formed of one or preferably several continuous filaments, in particular obtained by polymer extrusion.

BRIEF DESCRIPTION OF THE DRAWINGS

The invention will be better understood by following the description and accompanying drawings, which show a non-limiting exemplary embodiment of the invention. More in particular, in the drawing.

DETAILED DESCRIPTION OF AN EMBODIMENT

With initial reference to FIGS. 1 to 4, an embodiment of a device according to the invention is described in detail. The subsequent FIGS. 5 to 8 show exemplary embodiments of machines in which one or more of these devices can be inserted.

Figure 1:
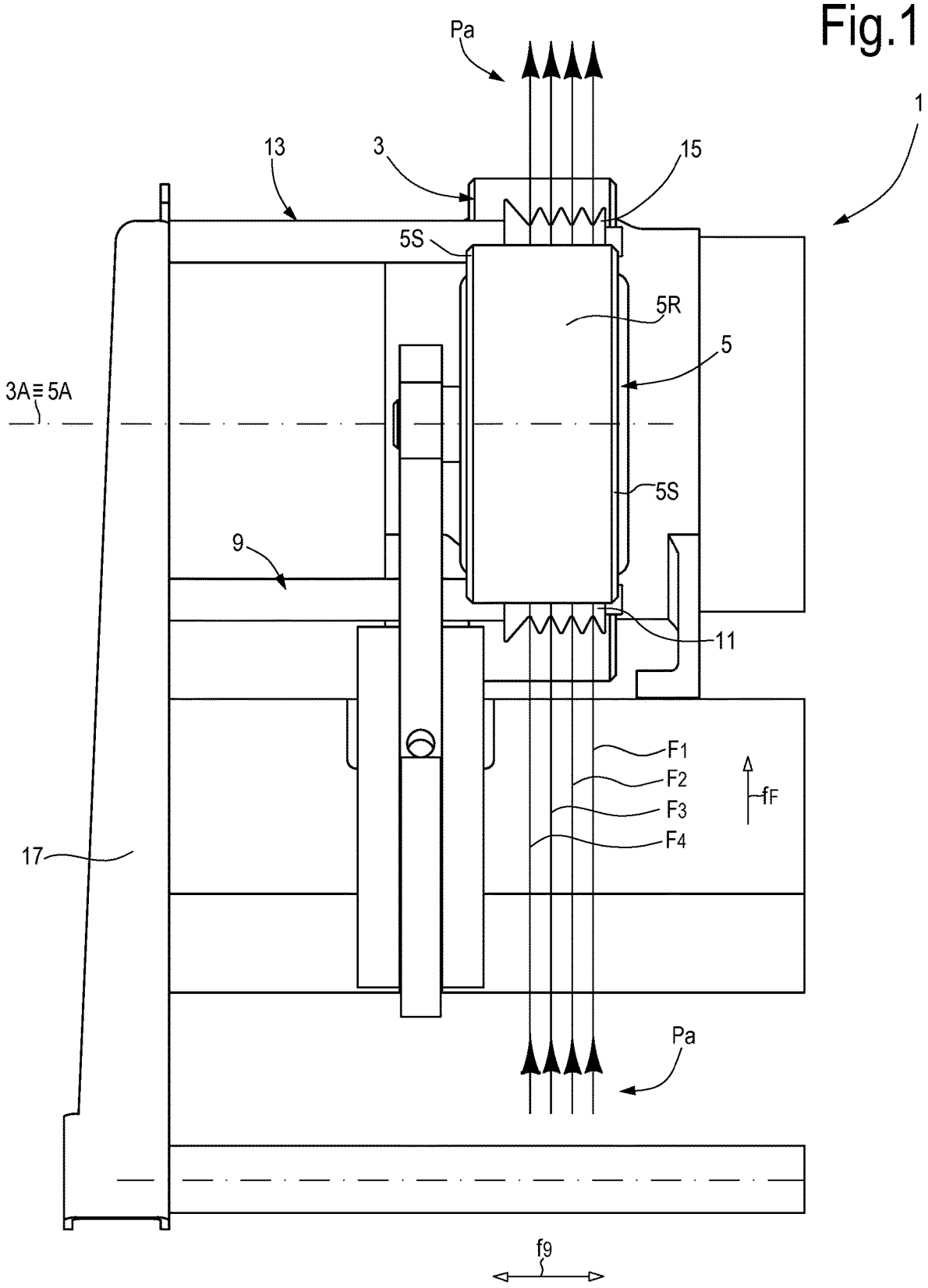
FIG. 1 shows a front view of a device according to the invention for producing fancy yarns in a first operating condition.

With initial reference to FIG. 1, the device for producing fancy or slub effects on one or more yarns is indicated as a whole with 1. In the embodiment illustrated, the device 1 comprises a first roller 3 rotating about a first rotation axis 3A. The device 1 further comprises a second roller 5 rotating about a second rotation axis 5A, substantially parallel to the first rotation axis 3A. In general, at least one of the two rollers 3, 5 is motorized. The other of the two rollers can be motorized or idle, for example rotated as a result of contact with the motorized roller. In some embodiments, the roller 3 can be motorized and the roller 5 can be idle. The motor of the roller 3 is not shown in the drawings. It can be mechanically connected to a shaft 3B on which the roller 3 is fitted. It would also be possible to arrange the motor on the roller 5, instead of on the roller 3, or on both the two rollers 3, 5.

One of the two rollers 3, 5 can be coated with a material with high coefficient of friction, such as natural rubber, synthetic rubber, or the like. In the embodiment shown, the roller 5 is coated with a coating 5R made of a material with high coefficient of friction, so that the mutual contact between the rollers 3, 5 allows motion to be transmitted from the roller 3 to the roller 5.

Figure 2:
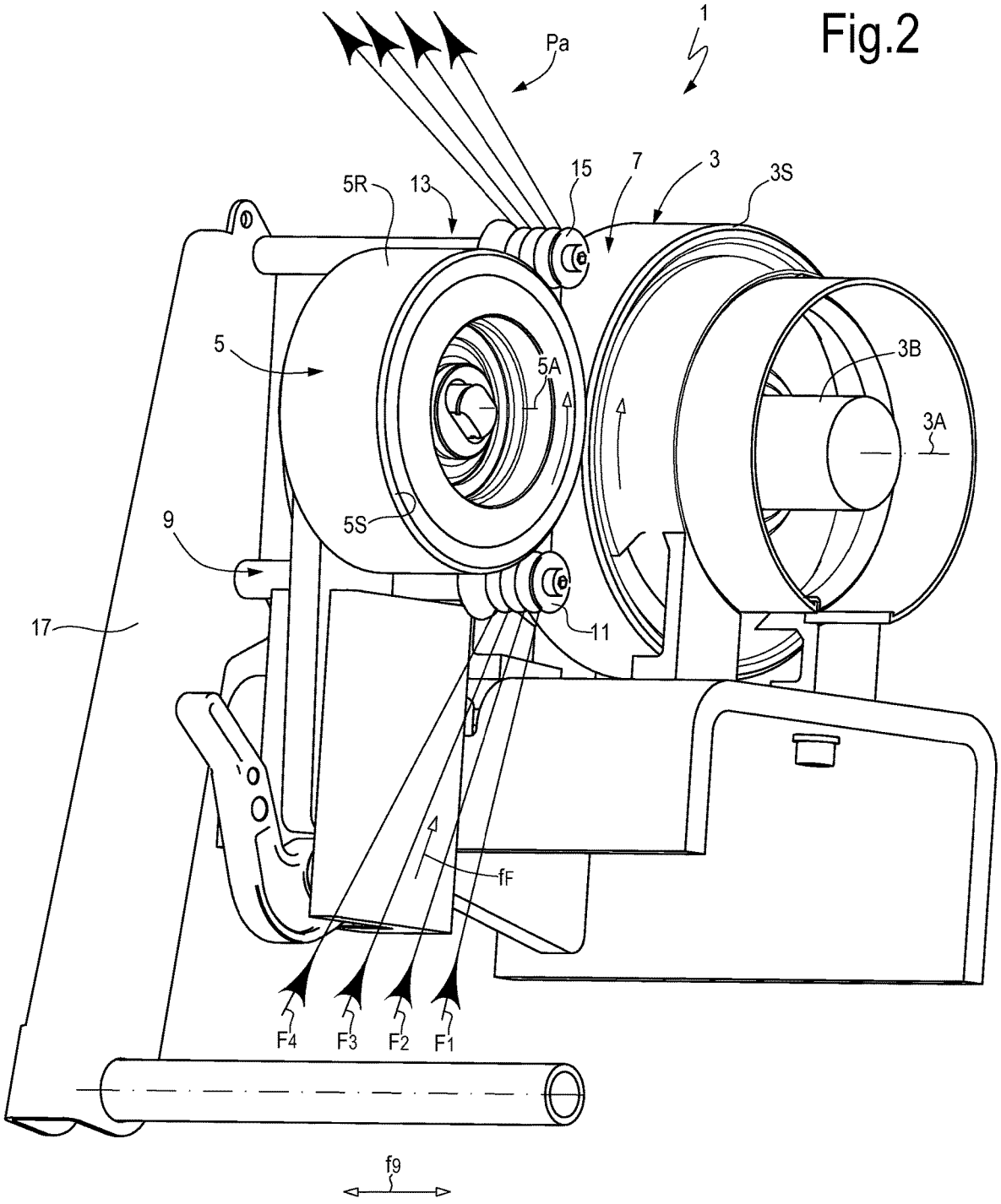
FIG. 2 shows an axonometric view of the device of FIG. 1.

The two rollers 3, 5 are in mutual contact and form therebetween a yarn passage 7, which is pinched between the rollers 3, 5 in the mutual contact area between them. In the present context, the area between the rollers 3, 5 where they are in mutual contact, and in which the yarn passage is defined, is also called nip 7. A feed path of yarns F1, F2, F3, F4 is indicated with Pa. In some operating conditions of the device 1 the feed path Pa passes through the nip 7, i.e., through the yarn passage 7 defined in the contact area between the rollers 3, 5, as shown in FIGS. 1, 2. In other operating conditions, described below, the feed path Pa of one or more yarns F1, F2, F3, F4 can pass outside the nip 7, i.e., outside the mutual contact area between the rollers 3, 5. While the embodiment of FIGS. 1 to 4 shows four adjacent yarns from F1 to F4, which advance along the same feed path Pa, in other embodiments, or in methods of use, a different number of yarns, for example even only one yarn, can be provided.

The device 1 further comprises a first guide member 9, with a head 11 forming one or more guide elements for one or more yarns F1-F4. In the example shown, the guide member 9 comprises a head 11 that forms four guide elements for the four yarns.

In some embodiments, the device 1 comprises a second guide member 13, with a head 15 forming one or more guide elements for the yarns F1-F4. In preferred embodiments, the first guide member 9 and the second guide member 13 are substantially identical to one another. In some embodiments, the two guide members 9, 13 can be mechanically connected to one another; for example, they can be connected to a same support 17.

The heads 11 and 15 can have ceramic bodies that define one or more guide grooves for the yarns. In the example illustrated the heads 11 and 15 each have four guide grooves.

The two guide members 9, 13 are positioned one upstream and the other downstream of the nip 7, or contact area between the rollers 3, 5, with respect to the direction of advance of the yarns F1-F4 along the feed path Pa. Said direction of advance is indicated by arrow fF. The heads 11, 15 of the two guide members 9, 13 can be arranged so that the portion of the feed path Pa of the yarns F1-F4, defined between the two heads 11, 15 is approximately orthogonal to a plane containing the two rotation axes 3A, 5A of the two rollers 3, 5.

The two guide members 9, 13 and the related heads 11, 15 are provided with a reciprocating translation motion according to the double arrow f9 with respect to the rollers 3, 5. The movement is clearly visible comparing FIGS. 1, 3 and FIGS. 2, 4. In the example illustrated the movement is such as to take the heads 11, 15 of the guide members 9, 13 from a first position (FIGS. 1, 2) aligned with respect to the contact area 7 between the rollers 3, 5, to a second position (FIGS. 3, 4) offset with respect to the rollers 3, 5 and to the mutual contact area 7 of the rollers. More in particular, in the condition of FIGS. 1, 2 the position of the guide members is such that the portion of feed path Pa between the two heads 11, 15 passes through the contact area 7 between the rollers 3, 5. Vice versa, in the condition of FIGS. 3 and 4 the position of the portion of feed path Pa between the two heads 11, 15 is outside the contact area 7 between the rollers 3, 5.

Figure 3:
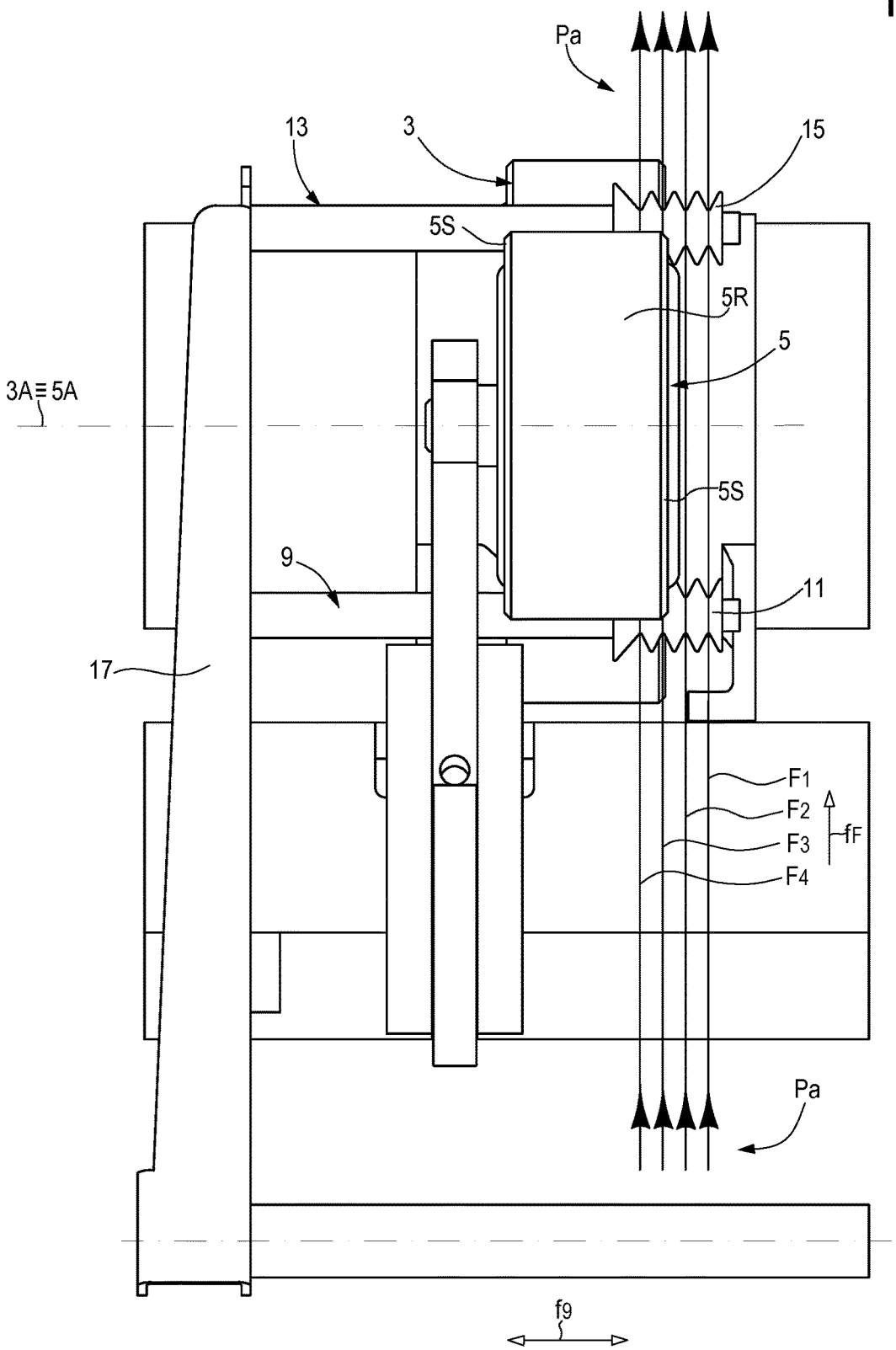
FIG. 3 shows a front view of the device of FIGS. 1 and 2 in a second operating position.
Figure 4:
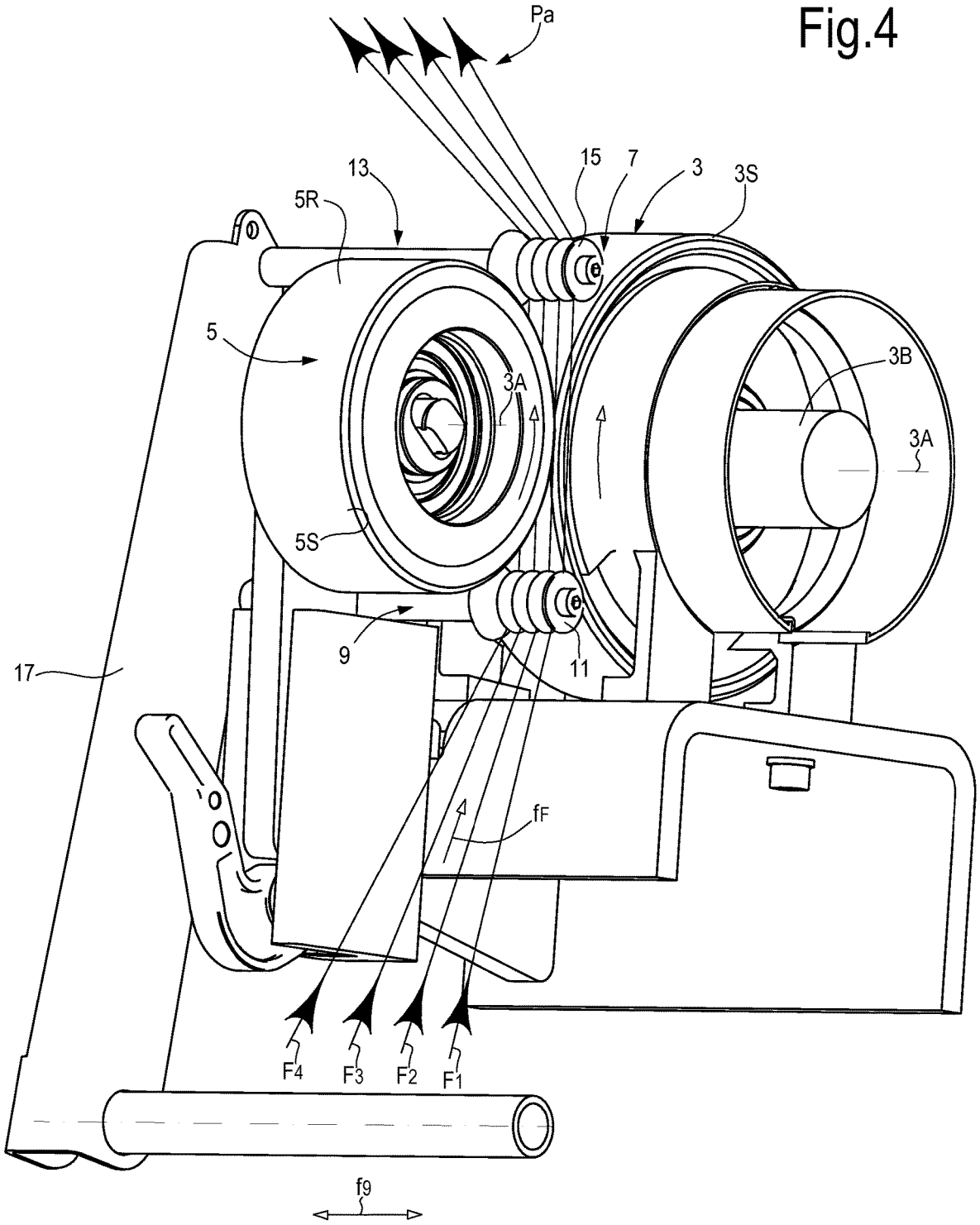
FIG. 4 shows an axonometric view of the device of FIG. 3.

In the view of FIGS. 3 and 4 only a part of the path Pa is outside the contact area 7 between the rollers 3, 5, in the sense that only two yarns F1, F2 are not in contact with respect to the rollers 3, 5, while the other yarns F3, F4 still pass between the rollers 3, 5 and in contact therewith. However, it must be understood that the translation stroke of the two guide members 9, 13 can be greater than indicated, i.e., the two guide members can move further with respect to what is shown in the drawing, so that their heads 11, 15 are completely staggered with respect to the position of the rollers 3, 5, so that the feed path Pa of all the yarns F1-F4 is located outside the nip 7.

The motion according to f9 is a reciprocating motion that can be controlled electronically, for example so that it is periodic, with a simple or complex law of motion, or random, for the purposes that will apparent from the description below. Therefore, the yarns F1-F4 are repeatedly taken from the position between the rollers 3, 5 (FIGS. 1, 2) to a position outside the rollers 3, 5 and vice versa. To facilitate insertion of the yarns F1-F4 into the nip 7 between the rollers 3, 5, after they have been taken out, the edges of the rollers 3, 5 can be beveled, as indicated in 3S and 5S in FIGS. 2 and 4.

Due to the fact that the two guide members 11, 13 are fixed to a common support 17, the reciprocating translation movement according to f9 can be imparted on the two guide members 11, 13 by a same actuator, not shown. For example, the translation movement can be imparted by an electronically controlled electric motor, in combination with a mechanical transmission that converts the rotational motion of the electric motor into a translational motion of the support 17.

Operation of the device described above is as follows. The rollers 3, 5 can belong to a drawing assembly, arranged along a yarn feed path in a complex machine, for example a texturizing machine. Exemplary embodiments of these machines will be described below with reference to FIGS. 5 to 8. When the yarn or the yarns F1-F4 are located in the nip or contact area 7 between the rollers 3, 5, they are pinched between said rollers 3, 5 (FIGS. 1, 2). The peripheral speed of the rollers 3, 5 with respect to the peripheral speed of another pair of rollers, which can be positioned upstream or downstream along the yarn path, controls the tension of the yarns F1-F4. When the yarns F1-F4 are moved laterally outside the mutual contact area of the rollers 3, 5, they are not subject to the action of the rollers 3, 5. By taking the yarns F1-F4 alternately inside and outside the passage 7 between the rollers 3, 5, it is thus possible to impart on the yarns a suddenly variable drawing effect, which generates fancy effects on the yarn.

Figure 5:
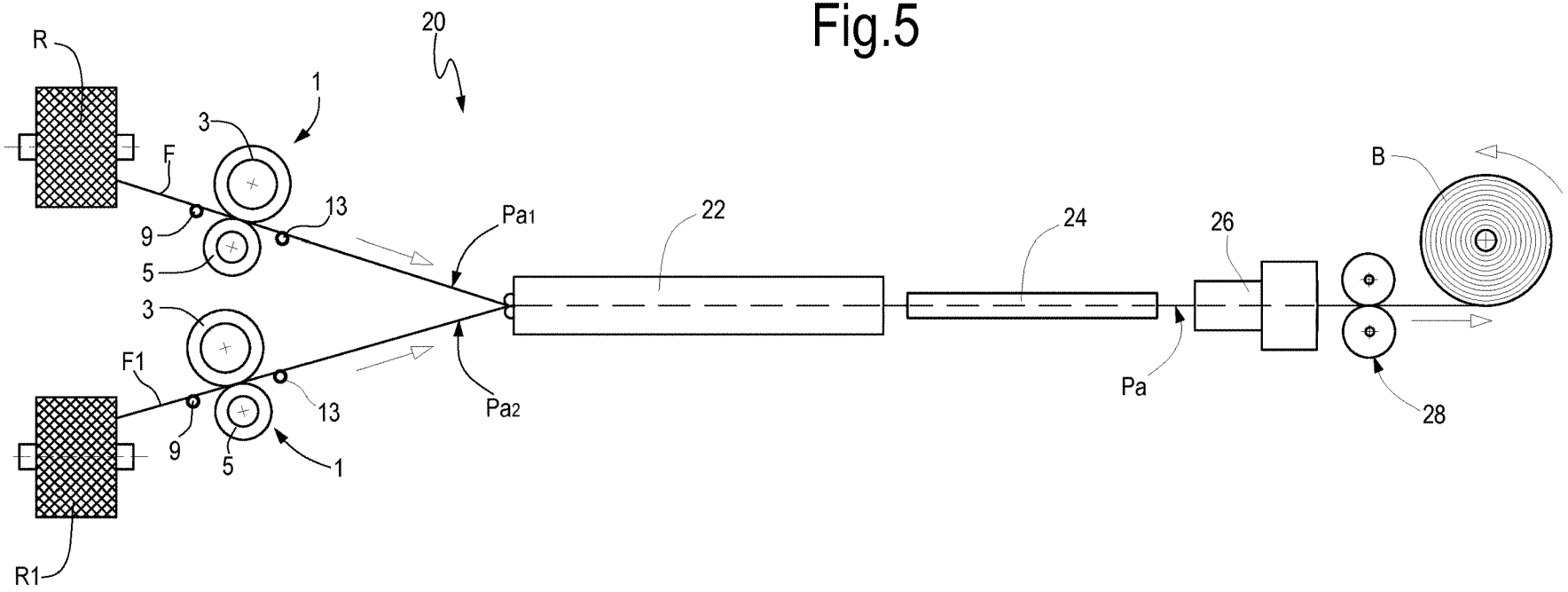
FIG. 5 shows a diagram of a false twist texturizing machine comprising a device according to the invention.

A first simplified layout of a texturizing machine, in which a device 1 of the type illustrated in FIGS. 1 to 4 can be used, is shown in FIG. 5. The machine is indicated as a whole with 20. The texturizing machine 20 shown by way of example in FIG. 5 is a false twist texturizing machine. In the embodiment illustrated, the machine 20 comprises a first feed path Pa1 from a feed reel R to an oven 22. A device 1 as described above and illustrated in FIGS. 1 to 4 is arranged along the feed path Pa1 of the yarn F. Downstream of the oven 22 the feed path of the yarn F is indicated with Pa and the following are arranged along said path: a cooling plate 24, a false twist assembly 26, a feed assembly 28. The feed assembly 28 can comprise a pair of rollers. At least one roller is motorized. The peripheral speed of the rollers of the feed assembly 28 and of the device 1 can be controlled so as to introduce the desired degree of drawing in the yarn F.

Operation of the machine 20 as a whole, without the device 1, is known (see, for example U.S. Pat. No. 6,820,405). The addition of the device 1 allows a sudden modification of the draw of the yarn F along the feed path Pa1, taking the yarn F rapidly inside and outside the mutual contact area 7 between the rollers 3, 5 of the device 1 in the manner described above. This causes the formation of fancy effects in the yarn.

In a modified embodiment, as illustrated in FIG. 5, a second feed reel R1, which feeds a second yarn Fl along a second path Pa2 through a second device 1, can be provided. The two yarns F and F1 are then fed to the same oven 22 and along the common path Pa to be wound.

Figure 6:
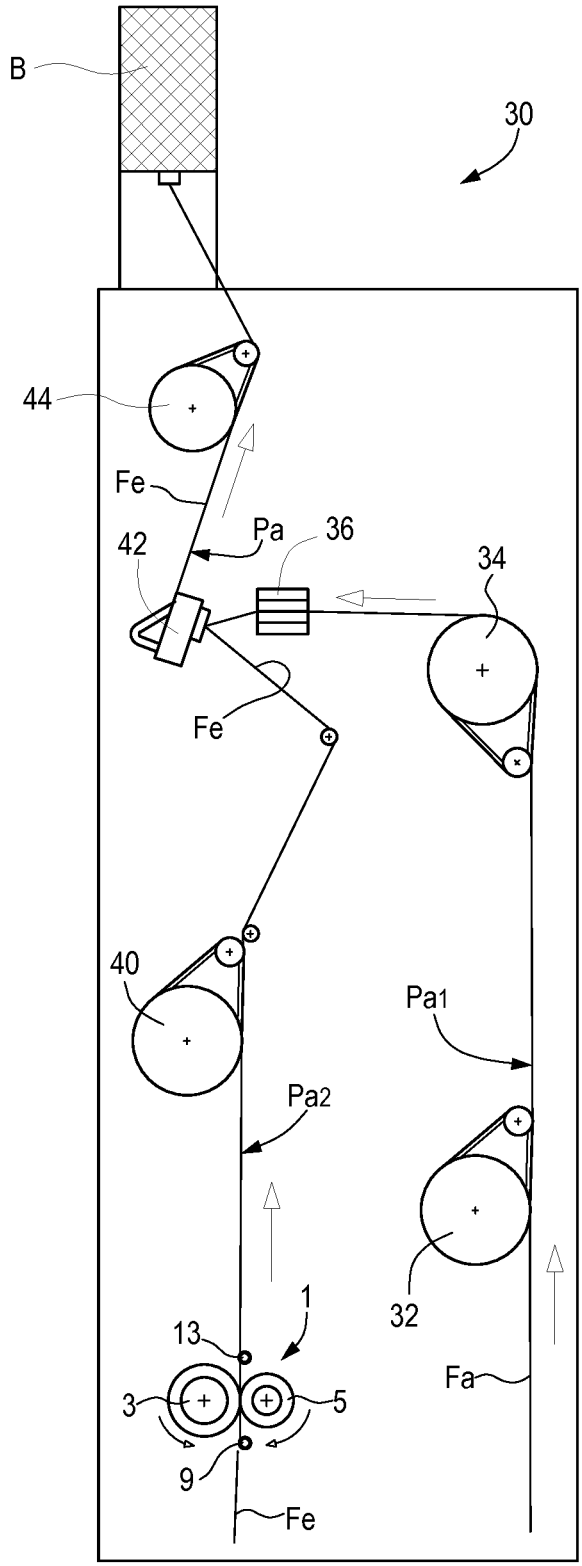
FIG. 6 shows a diagram of an air texturizing machine with a device according to the invention.

FIG. 6 schematically shows an air texturizing machine 30, for example of the type disclosed in U.S. Pat. No. 6,820,405, in which a device 1 according to the present invention is inserted. Two spools, not shown, feed a core yarn Fa and an effect yarn Fe along respective feed paths Pa1, Pa2. A first heating godet 32 and a second heating godet 34 can be arranged along the feed path Pa1, upstream of a wetting head 36. The device 1 described above and, downstream thereof, a heating godet 40 can be arranged along the feed path Pa2.

The feed paths Pa1, Pa2 converge into a common feed path Pa in which an air texturizing jet 42 is located and where the two yarns Fa and Fe are combined to form a composite yarn Fc. The feed path Pa ends with a take-up assembly B of the yarn on a bobbin. A master godet 44 that sets the speed of the machine is arranged upstream of the take-up assembly B.

The device 1 allows the tension in the yarn Fe, and consequently its degree of draw, to be modified rapidly and repeatedly, generating variable effects on the yarn upstream of the interlacing jet 42.

FIGS. 5 and 6 illustrate schematic diagrams of two possible texturizing machines, respectively false twist and air texturizing machines, in which a device 1 of the type illustrated above can be used. In the practical embodiment, texturizing machines can take configurations differing greatly from one another and can also comprise combinations of members, devices and components, to alternatively carry out friction, i.e., false twist, or air texturizing operations.

Figure 7:
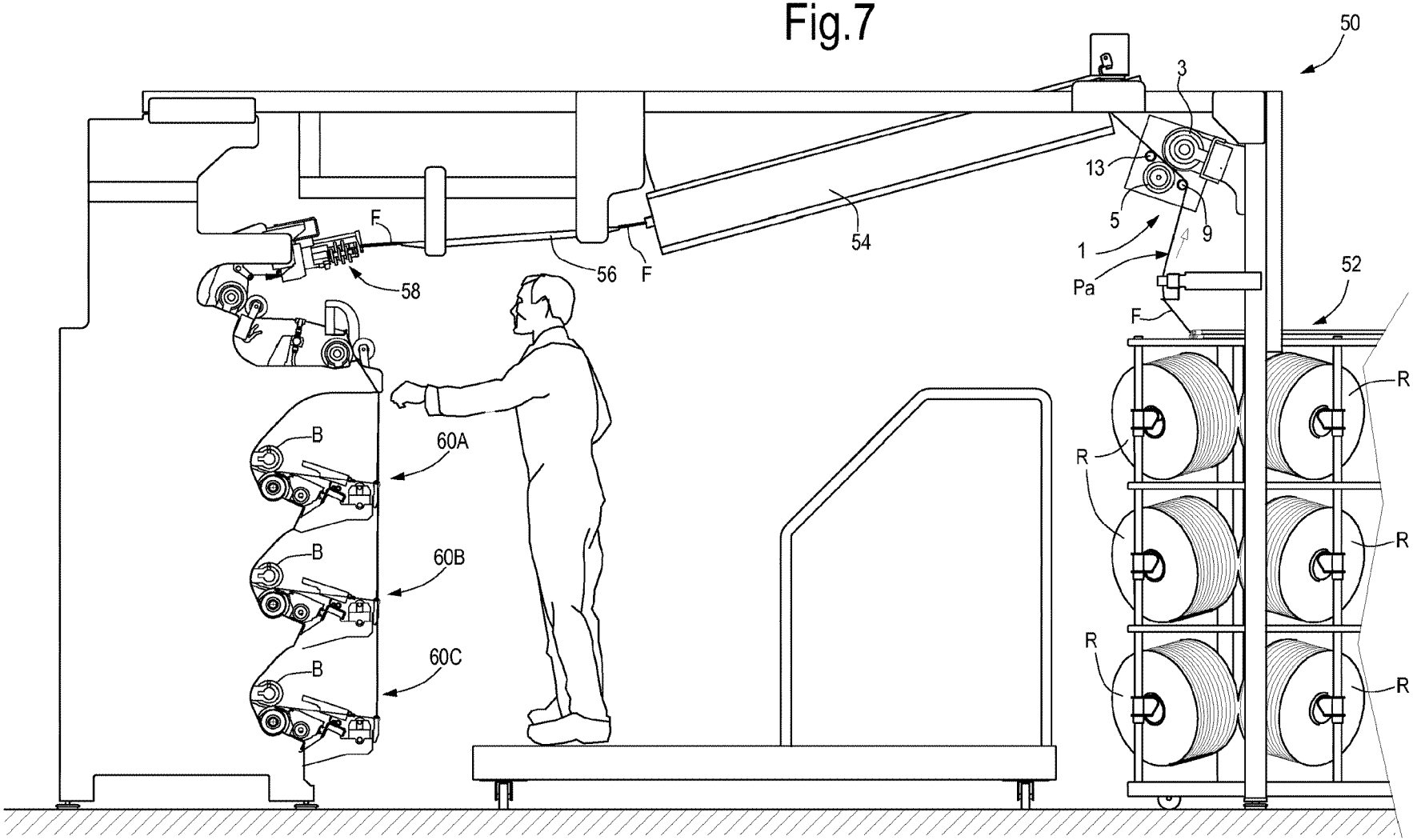
FIG. 7 shows a side view of a false twist texturizing machine, comprising devices according to the invention.
Figure 8:
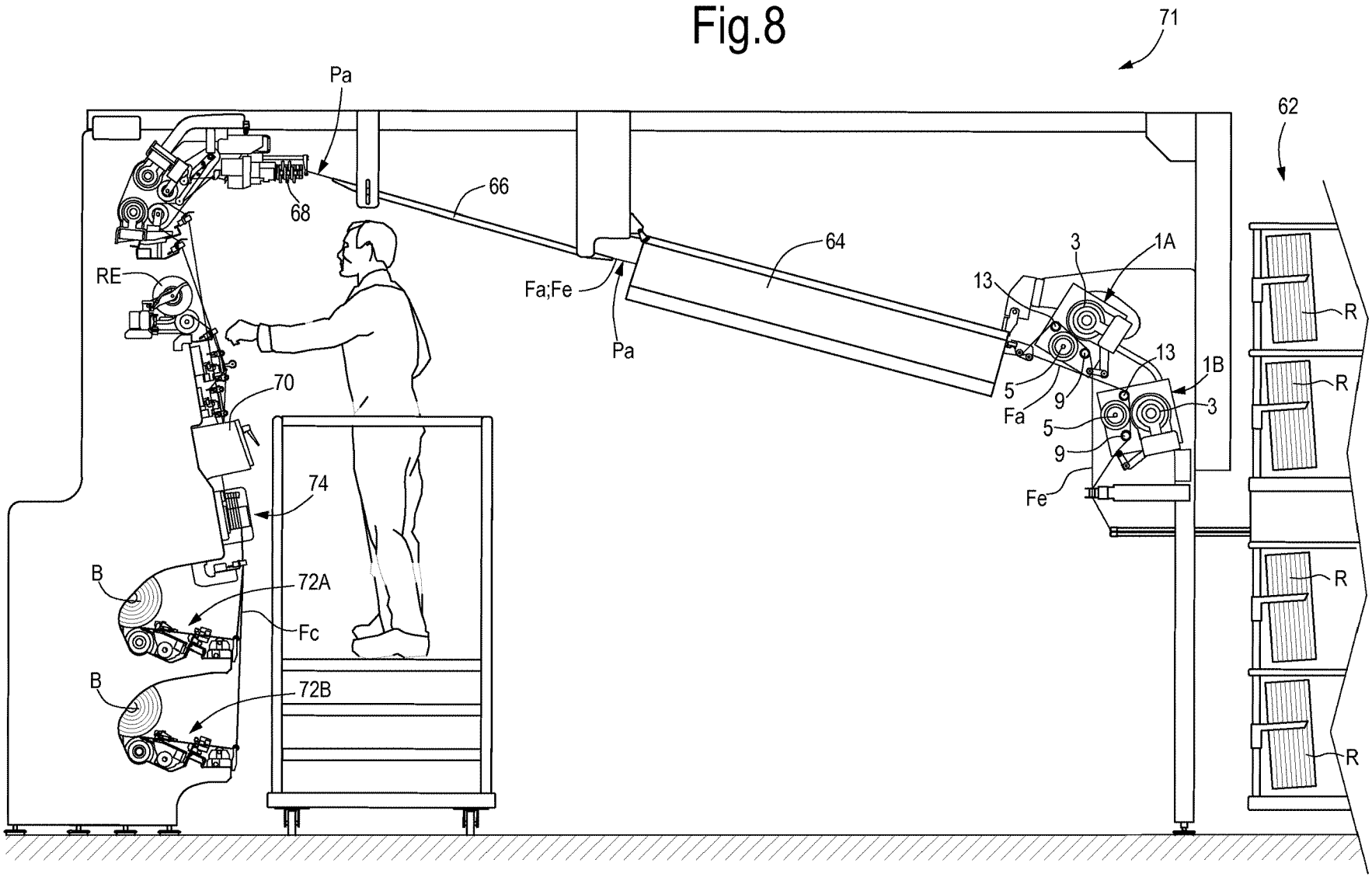
FIG. 8 shows a side view of a combined false twist and air texturizing machine for producing composite yarns, comprising a device according to the invention.

FIGS. 7 and 8 show a more detailed side view of embodiments of texturizing machines in which the device 1 can be used. It must be understood that the embodiments of FIGS. 7 and 8 are provided purely by way of example, and that the device 1 can be used in a plurality of machines for producing or converting simple or composite yarns, in which variable effects are desired.

More in particular, FIG. 7 shows a side view of a texturizing machine 50, which can have a plurality of units mutually aligned along a front that extends orthogonally to the plane in the figure. Only one texturizing unit is visible in FIG. 7. The machine comprises a creel 52, where spools R for feeding a yarn F to be texturized are arranged. Each texturizing unit can comprise several take-up and winding assemblies of a yarn F, fed from the spools R positioned on the creel 52. The yarns are texturized and wound on bobbins B. The example illustrated shows three take-up assemblies 60A, 60B, 60C, in which respective bobbins B of texturized yarn are formed. An oven 54 and a cooling plate 56 are positioned along a feed path Pa of the yarns F coming from the spools R positioned on the creel 52. A false twist assembly 58 is positioned downstream of the cooling plate 56. The briefly described machine 50 is per se known.

A device 1 of the type illustrated in FIGS. 1 to 4 is positioned between the creel 52 and the oven 54. Through the guide members 9, 11 sudden draw, and hence of tension variations, can be introduced to the yarns F, fed through one or more devices 1, with consequent formation of variable effects.

FIG. 8 shows a side view of a texturizing machine 71, for producing composite texturized yarns FC, which are wound on bobbins B. The texturizing machine 71 is a combined machine, comprising false twist units and air texturizing jets, to alternatively perform false twist texturizing or air texturizing. The reference number 62 indicates a creel, in which the yarn spools Rare arranged. Some spools R contain a core yarn Fa and others contain an effect yarn Fe. Both the yarns Fa, Fe can be made to pass through a device 1 of the type illustrated in FIGS. 1 to 4. In FIG. 8 the two devices are indicated with 1A and 1B. In other embodiments, only the yarn Fa or only the yarn Fe can be made to pass through a device 1, while the other can pass through a normal feed assembly, which introduces a constant draw in the yarn. For example, the following are arranged along the common feed path Pa of the yarns Fa, Fe: an oven 64, a cooling plate 66, a false twist assembly 68, an interlacing jet or an air texturizing jet 70. A spool RE of elastomeric yarn can feed an elastic yarn into the interlacing jet, together with the yarns Fa, Fe. Downstream of the jet 70 the composite yarn Fc obtained is fed by a godet or by a system of hot or cold rollers 74 and taken up on a respective take-up assembly 72A, 72B to be wound in a bobbin B.

It must be understood that the diagrams of FIGS. 5 to 8 illustrate only some exemplary embodiments of some types of machines in which the device 1 can be used. It can be used, in general, in machines for producing and converting yarns of various types provided with different units, assemblies or devices that perform one or more operations on a yarn or on several yarns fed in parallel and intended to be combined with one another in various ways, such as core yarns, effect yarns, elastomeric yarns, etc. In general, the device can be used in machines in which one or more yarns are subject to a drawing action, and in which variable effects can be obtained by sudden variations in the yarn tension.

Moreover, it must be understood that the device 1 can be used in single or multiple machines, for example in machines as illustrated in FIGS. 7 and 8, where even a very large number of units for producing or converting yarn are aligned with one another along one or more fronts. The various units can have common mechanical operating members, such as common shafts that control the rotation of several rotating members in parallel, for example several devices 1 adapted to feed yarns to several take-up assemblies. However, it would also be possible also to use the devices 1 on single machines, or machines containing a limited number of operating units, in which each roller 3 or 5 of each device 1 can be operated by its own independent motor.

The invention claimed is:

1. A device for generating variable drawing effects on a yarn, the device comprising:

a first roller rotatable about a first rotation axis, the first roller having a first axial end and a second axial end;

a second roller rotatable about a second rotation axis, parallel to the first rotation axis, the second roller having a first axial end and a second axial end, wherein the first roller and the second roller are in contact with each other along a nip and define between them, in a mutual contact area, a yarn passage extending through said nip; and wherein at least one of said first roller and second roller is motorized; and at least a first guide member and a second guide member which define a feed path for at least one yarn, said feed path extending through the nip between the first roller and the second roller; wherein the first guide member is arranged upstream of the nip with respect to a feed direction of the yarn along said feed path, and the second guide member is arranged downstream of the nip with respect to the feed direction of the yarn along said feed path;

wherein the first guide member and the second guide member are adapted to move synchronously with one another with respect to said first roller and second roller in a direction approximately parallel to the first rotation axis and to the second rotation axis, said movement being such as to take the yarn outside the nip between the first roller and the second roller by moving the yarn beyond at least one of said first axial ends and said second axial ends of the first roller and second roller.

2. The device of claim 1, wherein the first guide member and the second guide member define between them a portion of said feed path which is substantially orthogonal to a plane containing the first rotation axis and the second rotation axis.

3. The device of claim 1, wherein the first guide member and the second guide member comprise respective guide elements to guide a plurality of yarns side by side with one another.

4. The device of claim 1, wherein one of said first roller and second roller is idle, and is adapted to be driven in rotation through contact with the other of said first roller and second roller, which is motorized.

5. The device of claim 1, wherein the first roller and the second roller each have at least one beveled edge.

6. A machine for producing a fancy yarn, the machine comprising:

a feed path for at least one yarn from at least one feed spool to a winding bobbin; and, at least one device for generating variable drawing effects on the at least one yarn, wherein along said feed path there is arranged at least a yarn processing member and the at least one device, and the at least one device comprises:

a first roller rotatable about a first rotation axis, the first roller having a first axial end and a second axial end;

a second roller rotatable about a second rotation axis, parallel to the first rotation axis, the second roller having a first axial end and a second axial en& wherein the first roller and the second roller are in contact with each other along a nip and define between them, in a mutual contact area, a yarn passage extending through said nip; and wherein at least one of said first roller and second roller is motorized; and at least a first guide member and a second guide member which define a feed path for at least one yarn, said feed path extending through the nip between the first roller and the second roller; wherein the first guide member is arranged upstream of the nip with respect to a feed direction of the yarn along said feed path, and the second guide member is arranged downstream of the nip with respect to the feed direction of the yarn along said feed path; wherein the first guide member and the second guide member are adapted to move synchronously with one another with respect to said first roller and second roller in a direction approximately parallel to the first rotation axis and to the second rotation axis, said movement being such as to take the yarn outside the nip between the first roller and the second roller by moving the yarn beyond at least one of said first axial ends and said second axial ends of the first roller and second roller.

7. The machine of claim 6, wherein a further pair of rollers is arranged along the feed path, a rotation speed of the rollers of the further pair of rollers and the rotation speed of the first and of the second roller of the device being adapted to control the tension of the yarn.

8. The machine of claim 7, wherein said processing member is selected from the group comprising: an oven, a godet roller, a false twist, an interlacing or texturizing jet, a combination thereof.

9. A method for producing a fancy yarn, comprising the steps of:

feeding at least one yarn along a feed path between a first roller rotating about a first axis, and a second roller, rotating about a second axis approximately parallel to the first axis, said first roller and second roller being in contact with each other and defining between them a yarn passage; wherein at least one of said first roller and second roller is motorized;

guiding the yarn by means of a first guide member upstream of the yarn passage with respect to a feed direction of the yarn;

guiding the yarn by means of a second guide member downstream of the yarn passage with respect to the feed direction of the yarn;

moving the first guide member and the second guide member simultaneously in a direction substantially parallel to the rotation axes of the first roller and of the second roller while the yarn advances along the feed path, such as to temporarily move the yarn outside the yarn passage between the first roller and the second roller and returning the yarn inside the yarn passage between the first roller and the second roller and imparting on the yarn a variable drawing effect therewith.

* * * * *